US009852619B2

(12) United States Patent
Broszeit

(10) Patent No.: US 9,852,619 B2
(45) Date of Patent: Dec. 26, 2017

(54) COMMUNICATION DEVICE FOR AN ULTRASONIC APPLIANCE, AND METHOD FOR OPERATING SUCH AN APPLIANCE

(71) Applicant: Weber Ultrasonics GmbH, Karlsbad-Ittersbach (DE)

(72) Inventor: Ralf Broszeit, Pforzheim (DE)

(73) Assignee: Weber Ultrasonics GmbH, Karlsbad-Ittersbach (DE)

( * ) Notice: Subject to any disclaimer, the term of this patent is extended or adjusted under 35 U.S.C. 154(b) by 80 days.

(21) Appl. No.: 14/430,605

(22) PCT Filed: Sep. 9, 2013

(86) PCT No.: PCT/EP2013/068614
§ 371 (c)(1),
(2) Date: Mar. 24, 2015

(87) PCT Pub. No.: WO2014/048712
PCT Pub. Date: Apr. 3, 2014

(65) Prior Publication Data

US 2015/0235553 A1 Aug. 20, 2015

(30) Foreign Application Priority Data

Sep. 25, 2012 (DE) ..... 10 2012 217 318

(51) Int. Cl.
*G08C 23/02* (2006.01)

(52) U.S. Cl.
CPC ..... *G08C 23/02* (2013.01)

(58) Field of Classification Search
CPC ..... E05F 3/02; E05F 3/221; E05Y 2201/21; E05Y 2201/256; E05Y 2201/264; E05Y 2900/132; G08C 23/02; Y10T 16/281
(Continued)

(56) References Cited

U.S. PATENT DOCUMENTS 5,391,144 A * 2/1995 Sakurai ..... A61B 17/22012 601/3
5,532,539 A 7/1996 Hielscher
(Continued)

FOREIGN PATENT DOCUMENTS

DE 4322388 1/1995
DE 102012215993 3/2014
DE 102012215994 3/2014

*Primary Examiner* — Yong Hang Jiang
(74) *Attorney, Agent, or Firm* — Volpe and Koenig, P.C.

(57) ABSTRACT

A method for operating an ultrasonic appliance (1), which ultrasonic appliance has an ultrasonic generator (2) and an ultrasonic oscillator (4) that has an electrical operative connection to the ultrasonic generator, wherein the ultrasonic generator supplies electric power to an ultrasonic transducer that the ultrasonic oscillator contains and stimulates said ultrasonic transducer to produce ultrasound. The proposed method is distinguished in that the ultrasonic oscillator and the ultrasonic generator communicate with one another (K1, K2), preferably digitally, via an operative data and/or signal connection, wherein the ultrasonic oscillator transmits identification data to the ultrasonic generator, which identification data allow the ultrasonic generator to recognize the ultrasonic oscillator. Furthermore, a communication device—suitable for carrying out said method—for an ultrasonic appliance and an ultrasonic appliance having such a communication device are provided.

13 Claims, 6 Drawing Sheets

(58) Field of Classification Search
USPC ..... 367/197
See application file for complete search history.

(56) References Cited

U.S. PATENT DOCUMENTS

| | | | | |
|---|---|---|---|---|
| 6,247,353 | B1 * | 6/2001 | Battenberg | G01H 1/003 73/40.5 A |
| 7,269,873 | B2 | 9/2007 | Brewer et al. | |
| 2003/0002562 | A1 * | 1/2003 | Yerlikaya | G01K 13/002 374/208 |
| 2004/0002657 | A1 * | 1/2004 | Marian | A61B 8/00 600/459 |
| 2006/0268029 | A1 * | 11/2006 | Kim | G06K 15/102 347/9 |
| 2011/0165571 | A1 | 7/2011 | De Beuckeleer et al. | |
| 2011/0285244 | A1 | 11/2011 | Lewis et al. | |

* cited by examiner

COMMUNICATION DEVICE FOR AN ULTRASONIC APPLIANCE, AND METHOD FOR OPERATING SUCH AN APPLIANCE

BACKGROUND

The invention relates to a method for operating an ultrasonic appliance.

The invention also relates to a communication device for an ultrasonic appliance and to an ultrasonic appliance.

Ultrasonic appliances of the type in question here regularly comprise an ultrasonic generator and an ultrasonic oscillating unit which has an electrical operative connection to the ultrasonic generator. The ultrasonic generator provides a high-frequency electrical excitation signal (HF excitation signal or HF signal) which is used to excite an (ultra)sonic transducer present in the ultrasonic oscillating unit to oscillate in order to generate the actual ultrasound.

The problem here is that it is generally readily possible to connect any desired ultrasonic oscillating unit to an ultrasonic generator even if the ultrasonic oscillating unit is not intended for use with the relevant ultrasonic generator. In particular, it is possible, in this connection, to operate the ultrasonic oscillating unit at an incorrect excitation frequency and/or at an excessively high power, which, in the worst-case scenario, may result in destruction of both components, that is to say the ultrasonic oscillating unit and the ultrasonic generator. If the power is too weak, the result of the ultrasonic machining will regularly not have the intended quality.

DE 43 22 388 A1 discloses a circuit arrangement for the safe oscillation build-up of ultrasonic disintegrators, in which, for the safe oscillation build-up of the sonic transducer with a coupled sonotrode, a wide frequency band of the ultrasonic generator (HF generator) is run through and the amplitude of a feedback signal from a piezoceramic disk is monitored in the process. If the feedback amplitude required for oscillation build-up is undershot, the frequency band is run through again. This makes it possible to compensate for wear and tear of sonotrodes, and overloading of the power output stage contained in the HF generator for controlling the ultrasonic transducer is avoided.

SUMMARY

The invention is based on the object of specifying a method and an apparatus which can be used to avoid, in particular, an ultrasonic oscillating unit, for example for a sonotrode or an emitter, being operated from an ultrasonic generator which is not suitable for this purpose and vice versa.

The object is achieved by a method, a communication device and an ultrasonic appliance having one or more features of the invention. Dependent claims each relate to advantageous developments, the wording of which claims is hereby incorporated in the description by express reference in order to avoid repeated text.

According to the invention, a method for operating an ultrasonic appliance, which ultrasonic appliance has an ultrasonic generator and an ultrasonic oscillating unit which has an electrical operative connection to the ultrasonic generator, the ultrasonic generator supplying an ultrasonic transducer contained in the ultrasonic oscillating unit with electrical energy and exciting it to generate ultrasound, is characterized in that the ultrasonic oscillating unit and the ultrasonic generator communicate with one another, preferably digitally, via an operative data and/or signal connection, the ultrasonic oscillating unit transmitting identification data to the ultrasonic generator, which identification data make it possible for the ultrasonic generator to recognize the ultrasonic oscillating unit.

A communication device according to the invention for an ultrasonic appliance, which ultrasonic appliance has an ultrasonic generator and an ultrasonic oscillating unit which has an electrical operative connection to the ultrasonic generator, the ultrasonic generator being designed to supply an ultrasonic transducer contained in the ultrasonic oscillating unit with electrical energy and to excite it to generate ultrasound, is characterized in that an operative data and/or signal communication connection is formed between the ultrasonic oscillating unit and the ultrasonic generator, the ultrasonic oscillating unit being designed to transmit data in the form of identification data and/or property data to the ultrasonic generator via the operative communication connection, preferably in a digital manner, and the ultrasonic generator being designed to recognize the ultrasonic oscillating unit using the data, preferably also to determine physical properties or states of the ultrasonic oscillating unit, in particular to carry out the method as claimed in one of the preceding method claims.

An ultrasonic appliance according to the invention having an ultrasonic generator and an ultrasonic oscillating unit which has an electrical operative connection to the ultrasonic generator is characterized by a communication device as claimed in one of the preceding apparatus claims.

The solution according to the invention therefore provides for communication to take place between the ultrasonic generator and the ultrasonic oscillating unit. This communication takes place, preferably digitally, via said operative data and/or signal connection. In this case, the ultrasonic oscillating unit transmits unique identification data to the ultrasonic generator, which identification data may comprise, for example, a serial number or the like, but without the invention being restricted thereto. Said identification data make it possible for the ultrasonic generator to recognize the ultrasonic unit. In this manner, the ultrasonic generator can discern, in particular, whether a connected ultrasonic oscillating unit is actually suitable for operation with the present generator type. This makes it possible to reliably avoid components being damaged or destroyed, as could occur according to the prior art.

In a development of the method according to the invention, it is also possible to transmit further properties of the ultrasonic oscillating unit to the ultrasonic generator, for example details of resonant frequencies, nominal power, power loss or the like. Further data such as a summed previous operating period of the ultrasonic oscillating unit (sound emission time) and/or details of starting and stopping frequencies for a frequency scan for determining an optimum operating range of the ultrasonic oscillating unit may also be transmitted. It is even possible to transmit the entire frequency-dependent impedance profile of the ultrasonic oscillating unit for optimal adjustment of the excitation signal. Corresponding methods for operating an ultrasonic appliance are described in already pending patent applications by the applicant, namely DE 10 2012 215 993.2 and DE 10 2012 215 994.0, to which reference is made in full.

With an appropriate configuration of the ultrasonic oscillating unit, in particular by providing suitable sensors, it is not only possible to retrieve or store permanently stored identification or property data but it is also possible to transmit dynamically determined property data relating to the ultrasonic oscillating unit to the ultrasonic generator, for example by measuring physical properties and parameters, in particular a current temperature of the ultrasonic oscillating unit or moisture values on or in the interior of the ultrasonic oscillating unit.

A corresponding development of the method according to the invention therefore provides for the ultrasonic oscillating unit to also transmit particular pre-stored or dynamically determined property data, or property data determined by means of sensors, relating to the ultrasonic oscillating unit to the ultrasonic generator. Without this list being exhaustive, said property data may comprise at least one of the following properties: nominal power, power loss, resonant frequencies, serial number, production date, sound emission time, impedance profile, starting and stopping frequencies for determining an operating range, temperature, moisture or the like.

A special development of the method according to the invention provides for an operating state of the ultrasonic generator to be automatically selected on the basis of a result of the recognition and/or the property data. This may mean that the excitation signal for the ultrasonic oscillating unit is adapted on the basis of the property data relating to the ultrasonic oscillating unit after said property data have been transmitted to the ultrasonic generator. This may mean, for example, that the excitation frequency is set to a value which is between the transmitted values for the starting and stopping frequencies, which frequencies may coincide with the resonant frequencies (series resonance and parallel resonance) of the ultrasonic oscillating unit. However, the extreme case may also include the fact that the ultrasonic generator does not apply any excitation signal whatsoever to the ultrasonic oscillating unit if it follows from the identification data or the property data that the connected ultrasonic oscillating unit must not be used with the present generator type. A similar behavior is also possible when a sound emission time which is stored in the ultrasonic oscillating unit and is transmitted to the ultrasonic generator indicates that the relevant ultrasonic oscillating unit already has an excessively long operating period and therefore could be defective. A corresponding procedure may also be followed if moisture has penetrated the ultrasonic oscillating unit, without the invention being restricted to these operating modes.

In a development of the method according to the invention, communication is preferably carried out in a bidirectional manner, the ultrasonic generator also transmitting data to the ultrasonic oscillating unit. With an appropriate configuration of the ultrasonic oscillating unit, said data may be stored there, for which purpose the ultrasonic oscillating unit may have a suitable storage element. This makes it possible, in particular, for the sound emission time of a connected ultrasonic oscillating unit to be continuously updated, which has already been discussed further above. In addition, the generator or generator type with which the ultrasonic oscillating unit has already been operated may be stored in the ultrasonic oscillating unit in this manner.

If provision is made for a given ultrasonic generator to function only with an ultrasonic oscillating unit whose identification data are accepted by the ultrasonic generator, it is also possible to avoid damage or hazards occurring as a result of the use of fake and possibly lower-quality ultrasonic oscillating units.

As part of one particularly advantageous development of the method according to the invention, communication between the ultrasonic generator and the ultrasonic oscillating unit is carried out via a high-frequency supply line between the ultrasonic generator and the ultrasonic oscillating unit, via which high-frequency supply line the high-frequency excitation signal for the ultrasonic oscillating unit is otherwise transmitted for the purpose of generating ultrasound. This configuration is particularly advantageous because no additional communication connections or communication lines are required. In terms of hardware, the corresponding method manages substantially with the components of a conventional ultrasonic appliance which are already present.

However, the invention is in no way restricted to the configuration described above. It goes without saying that it is within the scope of the present invention if communication is carried out via an additional communication line or wirelessly via a corresponding wireless communication connection between the ultrasonic generator and the ultrasonic oscillating unit.

As part of yet another development of the method according to the invention, the elements of the ultrasonic generator and/or of the ultrasonic oscillating unit which are involved in communication may be coupled to the high-frequency supply line or to a separate, wireless or wired communication connection between the ultrasonic generator and the ultrasonic oscillating unit in a contactless manner, preferably capacitively and/or inductively, or electrically.

In a corresponding development of the method according to the invention, a signal is expediently used for actual communication, which signal is modulated at a modulation frequency which is different from an excitation frequency for the ultrasonic oscillating unit. Said modulation frequency is preferably higher than the excitation frequency for the ultrasonic oscillating unit. This makes it possible to achieve, in particular, the capacitive and/or inductive coupling (described further above) of the elements involved in communication in a simple manner. These elements can accordingly be electrically designed in such a manner that they substantially do not respond to the HF excitation signal for the ultrasonic oscillating unit, whereas they are sufficiently sensitive to said modulation frequency of the actual communication signal.

Yet another development of the method according to the invention provides for elements of the ultrasonic oscillating unit which are involved in communication to be supplied with electrical energy by means of a separate energy supply. In particular, these elements may be in the form of a transponder which is an active transponder according to the above statements. Such a configuration is expedient, in particular, when dynamically determined property data relating to the ultrasonic oscillating system are transmitted to the ultrasonic generator, for which purpose corresponding sensors are regularly provided such that they have an operative connection to the ultrasonic oscillating unit. This separate energy supply may be, for example, an energy cell in the form of one or more rechargeable batteries.

Alternatively, provision may be made for elements of the ultrasonic oscillating unit which are involved in communication to be supplied with electrical energy passively, that is to say without a separate energy supply. The energy may be supplied, in particular, in a "parasitic" manner using the HF excitation signal. Such a configuration is expedient, in particular, when only pre-stored property data relating to the ultrasonic oscillating unit are transmitted to the ultrasonic generator. A so-called passive transponder may be provided in or on the ultrasonic oscillating unit for this purpose.

Corresponding further developments of the communication device according to the invention provide for an active or passive transponder to be provided such that it has an operative connection to the ultrasonic oscillating unit. This transponder has or stores the identification data and/or property data or has access to the identification data and/or property data for the purpose of transmission to the ultrasonic generator. In this case, at least one sensor, for example a temperature or moisture sensor, may be provided such that it has an operative connection to the ultrasonic oscillating unit, the sensor data (measured values) from which sensor are part or form the basis of at least the property data. This wording includes the fact that the sensor data are readily transmitted to the ultrasonic generator as property data, whereupon an "intelligent unit" (control unit) of the ultrasonic generator then evaluates the sensor data for control purposes. In principle, however, it is also possible for the ultrasonic oscillating unit to already have a corresponding "intelligent unit", for example a microprocessor or the like, which accordingly preprocesses the sensor data before transmission to the ultrasonic generator.

As already discussed, in a development of the communication device according to the invention, the ultrasonic generator may have a control unit which is designed to communicate with the ultrasonic oscillating unit and to evaluate the data received from the ultrasonic oscillating unit. In this context, it is possible to automatically select or adapt an operating state of the ultrasonic generator on the basis of the result of the recognition and/or the property data. Reference has already been made to this further above. Such selection or adaptation of the operating state may comprise, in particular, adaptation of the excitation signal for the ultrasonic oscillating unit to the transmitted property data relating to the ultrasonic oscillating unit. In the extreme case, the ultrasonic oscillating unit is not excited at all if the latter is unsuitable or defective, for example. Generally, the excitation signal will be adapted to the physical properties of the ultrasonic oscillating unit, for example by specifying an optimally suitable excitation frequency in the range between series resonance and parallel resonance of the ultrasonic oscillating unit.

If bidirectional communication takes place between the ultrasonic generator and the ultrasonic oscillating unit, the communication device according to the invention is distinguished in a corresponding development by virtue of the fact that a storage element is provided such that it has an operative connection to the ultrasonic oscillating element, which storage element can store data which are transmitted from the ultrasonic generator to the ultrasonic oscillating unit, for example a sound emission time (operating period).

One particularly advantageous embodiment of the invention comprises digital communication via the HF connection line (supply line) between the ultrasonic generator and the ultrasonic oscillating unit, which communication is achieved using high-frequency coupling. Actual communication is carried out by means of modulation at a higher frequency than the ultrasonic frequency to be emitted, via said HF line. In this case, there are preferably two coupling points, one of which is in or on the ultrasonic generator and the other of which is in or on the ultrasonic oscillating unit. As already mentioned, the coupling itself may be carried out capacitively, inductively or in a mixed form. Communication preferably takes place for the first time before the actual ultrasound emission and in this manner provides the ultrasonic generator with information relating to whether an ultrasonic oscillating unit is actually connected or a connected ultrasonic oscillating unit is suitable for operation. If a connected ultrasonic oscillating unit is defective or unsuitable, the ultrasonic generator can detect this and can output an error message, for example, and can disallow the sound emission. In contrast, if the ultrasonic oscillating unit is suitable owing to the design or on account of its resonant frequencies and (nominal) power, the ultrasonic generator can start the emission and can set the excitation frequency using optimal specifications, which specifications result from the transmitted property data relating to the ultrasonic oscillating unit.

Corresponding configurations of the communication device according to the invention provide for a so-called transponder to be provided in the ultrasonic oscillating unit. The transponder may have a passive or active construction. In the case of a passive transponder, its energy can be supplied in a "parasitic" manner using the HF excitation signal.

A transponder having an active construction allows measurements of physical properties of the ultrasonic oscillating unit using corresponding sensors and allows evaluation of the sensor data provided. The energy supply required for this purpose can be implemented in the form of rechargeable energy cells.

As already repeatedly mentioned, the modulated HF communication signals, that is to say those signals which are used for communication between the ultrasonic oscillating unit and the ultrasonic generator, can be coupled capacitively, inductively or in a mixed form of the two. In this case, the implementation on the side of the ultrasonic generator is independent of the implementation on the part of the ultrasonic oscillating unit.

Communication is possible not only before the first sound emission but also during the power output or sound emission in order to be able to react dynamically to physical properties of the ultrasonic oscillating unit, for example its temperature evolution. With an increased temperature, the aim is regularly to reduce the sound energy and/or the sound power.

In this connection, measurement data relating to physical properties of the ultrasonic oscillating unit are preferably transmitted to the ultrasonic generator virtually in real time.

The ultrasonic generator can use the transmitted (property) data relating to the ultrasonic oscillating unit to create a history in an existing storage element, which history comprises, for example, which ultrasonic oscillating element with which serial number has already been connected to the relevant ultrasonic generator.

Another development of the invention provides for communication to be coupled to the HF supply line via a transformer or a transformer-like coil. This type of coupling is independent of whether it is carried out on the side of the ultrasonic generator or on the side of the ultrasonic oscillating unit. Additionally or alternatively, it is possible for the coupling to be effected into the (electromagnetic) resonant circuit or the so-called matching network of the ultrasonic generator.

If the ultrasonic oscillating element has an active transponder, the energy cells provided for the purpose of supplying the latter are automatically charged during power output or sound emission, for example via the HF supply line.

As part of another development of the invention, the transponder of the ultrasonic oscillating element may consist of a digital computing unit or may comprise such a computing unit. In this connection, the transponder is able, in particular, to receive sensor data from corresponding sensors and to process said data, if necessary, before transmission to the ultrasonic generator.

If the ultrasonic oscillating unit reveals to the ultrasonic generator, during the proposed communication, what type of ultrasonic oscillating unit it is and what specific basic data or property data it has, it is possible for the ultrasonic generator to carry out optimal (frequency) control of the connected ultrasonic oscillating unit, in particular if a starting frequency and a stopping frequency which limit the preferred operating range of the ultrasonic oscillating unit are known, cf. DE 10 2012 215 993.2.

If a corresponding storage element is present, it is possible to implement a type of logbook in the ultrasonic oscillating unit, in which logbook errors can be logged and can be retrieved again at a subsequent time (by the ultrasonic generator).

In this manner, it is also possible for the ultrasonic oscillating system to store a history in its storage element, which history reveals the ultrasonic generators (identifiable via the serial number) with which the ultrasonic oscillating unit has already been put into operation.

The transmission of said identification/property data relating to the ultrasonic oscillating unit also makes it possible to activate a (pre-stored) program or a particular event in the ultrasonic generator during a tool change. In particular, such a program/event may comprise or cause one or more changes in physical properties of the HF excitation signal.

Corresponding programs or events may be stored in the ultrasonic generator and are accordingly activated when a tool change is detected. Alternatively, however, it is also possible to accordingly store process-relevant data in the ultrasonic oscillating unit and to automatically transmit them to the ultrasonic generator during a tool change, with the result that the ultrasonic generator can accordingly adapt its operation.

In addition to the already discussed sensor data for temperature and moisture, the ultrasonic oscillating unit may additionally or alternatively transmit sensor data in the form of an oscillation amplitude, HF current, HF voltage or the like or corresponding desired or limit values to the ultrasonic generator. The ultrasonic generator can immediately react to the transmitted sensor data by reducing, for example, the sound energy to be emitted and/or sound power to be output as the temperature of the ultrasonic oscillating unit increases.

The possibility of communicating the (entire) impedance profile of a connected ultrasonic oscillating unit to the ultrasonic generator, which impedance profile was stored in the transponder of the ultrasonic oscillating unit during production of the latter, has likewise already been discussed. The ultrasonic generator can react to this impedance profile and can accordingly adapt its operating parameters.

In principle, any data which are known during the production of the ultrasonic oscillating unit can be stored in the memory of the latter, for example the serial number, the material, the number of elements and/or PT disks, the piezo type used, the production date, the responsible tester, the capacitance, the power loss, the insulation resistance, a tightening torque, a tightening tension or the like, without the above list claiming completeness. It goes without saying that, during bidirectional communication, it is also possible for the ultrasonic generator to transmit data to the ultrasonic oscillating unit, which data have been verified by the ultrasonic generator itself using its own measurements, for example a frequency scan, cf. DE 10 2012 215 994.0. This makes it possible, under certain circumstances, to diagnose a defect in the ultrasonic oscillating unit if the generator measurements do not match the stored data relating to the ultrasonic oscillating unit.

BRIEF DESCRIPTION OF THE DRAWINGS

Further properties and advantages of the present invention emerge from the following description of exemplary embodiments using the drawing.

DETAILED DESCRIPTION OF THE PREFERRED EMBODIMENTS

Figure 1:
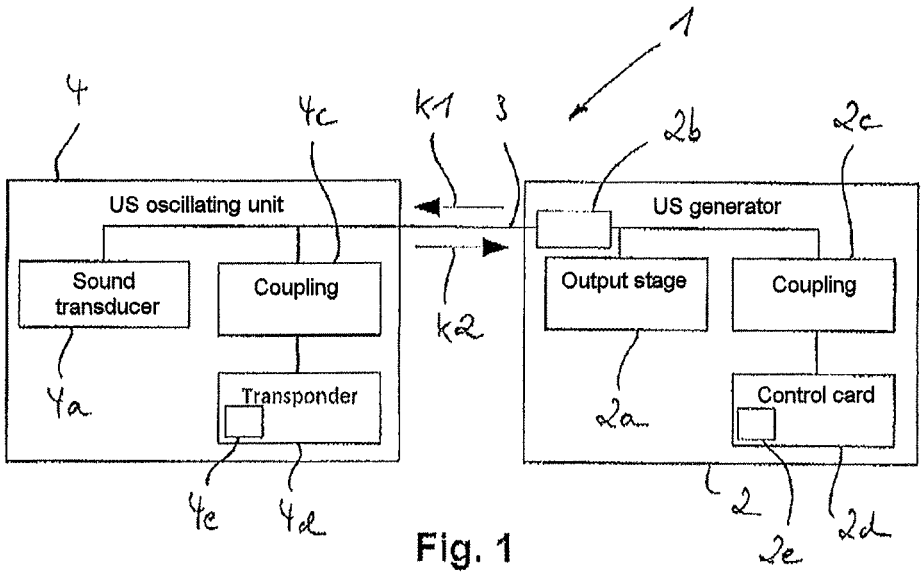
FIG. 1 schematically shows a first configuration of an ultrasonic appliance according to the invention having a communication device according to the invention for carrying out the method according to the invention.

FIG. 1 uses a block diagram to schematically show an ultrasonic appliance which is denoted as a whole using the reference symbol 1. The ultrasonic appliance 1 comprises an ultrasonic generator 2 to which an ultrasonic oscillating unit 4 is connected by means of a cable 3. The cable 3 functions as a supply line for a high-frequency excitation signal (HF signal) which is used by the ultrasonic generator 2 to excite the ultrasonic oscillating unit 4 to oscillate and therefore to generate ultrasound. For this purpose, the ultrasonic oscillating unit comprises an ultrasonic transducer (sound transducer) 4*a* which converts said HF signal into ultrasound. As is familiar to a person skilled in the art, the ultrasonic oscillating unit 4 also regularly comprises a so-called emitter which, on account of its special geometry, ensures the targeted emission or radiation of the generated ultrasound in an application-specific manner. This emitter is not explicitly illustrated in the figures.

In a manner known per se, the ultrasonic generator 2 has an output stage 2*a* which ensures that the HF signal to be emitted is appropriately amplified. On the output side, the ultrasonic generator 2 also has a so-called matching network 2*b* which is a circuit for matching the impedance between a source for high-frequency signals, here the ultrasonic generator 2, and a load, here the ultrasonic oscillating unit 4. Possible configurations and the function of such a matching network 2*b* are known to a person skilled in the art and shall not be discussed any further in the present case.

The important factor within the scope of the present invention is now the fact that the HF supply line 3 can be used or is used for preferably bidirectional communication of data between the ultrasonic generator 2 and the ultrasonic oscillating unit 4. This is symbolically illustrated in the figures by arrows K1 and K2. K2 denotes communication from the ultrasonic oscillating unit 4 to the ultrasonic generator 2, while K1 denotes the opposite communication direction. As already mentioned, communication is carried out via the HF supply line 3. For this purpose, both the ultrasonic generator 2 and the ultrasonic oscillating unit 4 each comprise a coupling element 2*c* or 4*c* which ensures that the relevant communication signals are coupled to and output from the HF supply line 3. The coupling itself can be carried out inductively, capacitively or in a mixed form. It may be respectively different for the ultrasonic generator 2 and the ultrasonic oscillating unit 4. Specific examples of such coupling are described in yet more detail further below using FIGS. 4 to 8.

It should be noted at this juncture that the invention is not restricted to bidirectional communication K1, K2. Furthermore, the invention is not restricted to communication K1, K2 taking place via the HF supply line 3. In principle, it is alternatively possible to provide a separate wireless or wired communication connection between the ultrasonic generator 2 and the ultrasonic oscillating unit 4.

In addition, the coupling can also be carried out inside the matching network 2*b* on the side of the ultrasonic generator 2, with the result that no completely separate coupling element 2*c* is fundamentally required.

The actual participants in communication K1, K2 are a control card 2*d* which is contained in the ultrasonic generator 2, functions as an intelligent unit and, in particular, can store and evaluate communication data transmitted by the ultrasonic oscillating unit 4 and can use said data to control the ultrasonic generator 2. For this purpose, the control card 2*d* has, in particular, a storage unit 2*e* which is designed, in particular, to store data transmitted by the ultrasonic oscillating unit 4. However, the storage element 2*e* may also store particular control programs or the like for operating the ultrasonic generator 2, which control programs can be used to control the ultrasonic generator 2 on the basis of data transmitted by the ultrasonic oscillating unit 4 or on the basis of the evaluation of said data in the control card 2*d*. On the side of the ultrasonic oscillating unit 4, the communication participant according to the configuration in FIG. 1 is a transponder 4*d* which for its part likewise has a storage unit 4*e* or can access such a storage unit. The storage unit 4*e* stores data which are transmitted by the transponder 4*d* to the ultrasonic generator 2 or its control card 2*d* via the HF supply line 3 during connection to the ultrasonic generator 2 or during operation. The introductory part of the description described in detail which data (identification data and/or property data) may be involved here.

The transponder according to the configuration in FIG. 1 is a so-called passive transponder which does not have its own energy supply and is therefore supplied with electrical energy in a "parasitic" manner via the HF supply line 3 or the coupling element 4*c*. Such transponders are known to a person skilled in the art in various forms.

With regard to the manner in which the data interchanged between the ultrasonic generator 2 and the ultrasonic oscillating unit 4 can be used to control operation of the ultrasonic appliance 1, reference is made to the introductory part of the description in order to avoid repetitions.

Figure 2:
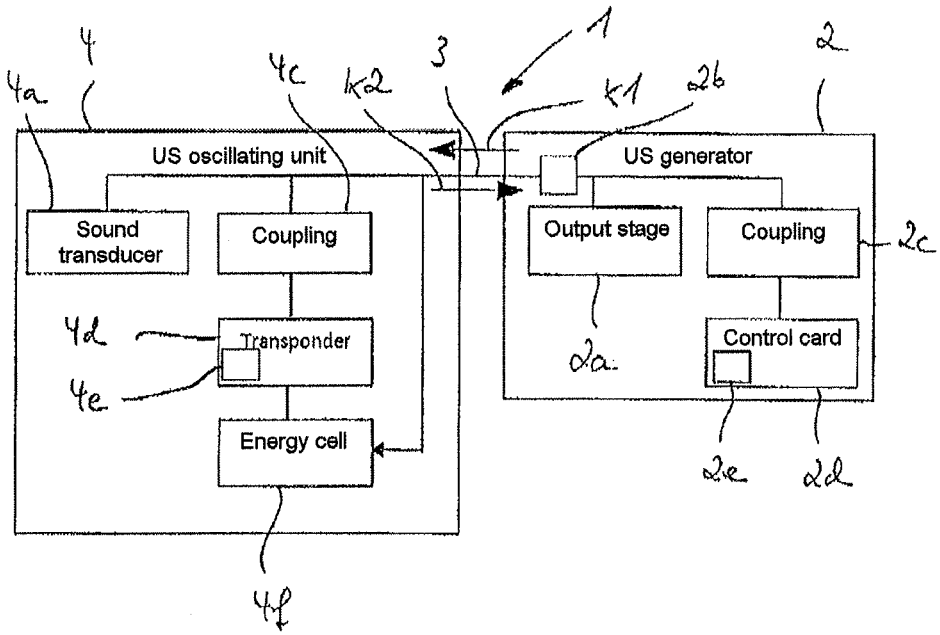
FIG. 2 schematically shows another configuration of an ultrasonic appliance according to the invention having a communication device according to the invention for carrying out the method according to the invention.

FIG. 2 uses a block diagram to schematically show an alternative configuration of the ultrasonic appliance 1, in which case only the important differences from the illustration according to FIG. 1 are discussed in more detail in the present case in order to avoid repetitions.

According to the configuration in FIG. 2, the transponder 4*d* in the ultrasonic oscillating unit 4 is in the form of an active transponder which has its own energy supply which is illustrated in the form of an energy cell 4*f*, by way of example. The energy cell 4*f* may be a rechargeable battery which, according to the illustration in FIG. 2, is supplied with electrical energy from the HF supply line 3 and is accordingly charged when the ultrasonic oscillating unit 4 is being connected to the ultrasonic generator 2 or during operation of the ultrasonic oscillating unit 4. The energy cell 4*f* then supplies the transponder 4*d* with electrical energy. The coupling element 4*c* is therefore used only for communication purposes and not to supply the transponder 4*d* with energy.

For the further details in FIG. 2, reference is made to the description of FIG. 1.

Figure 3:
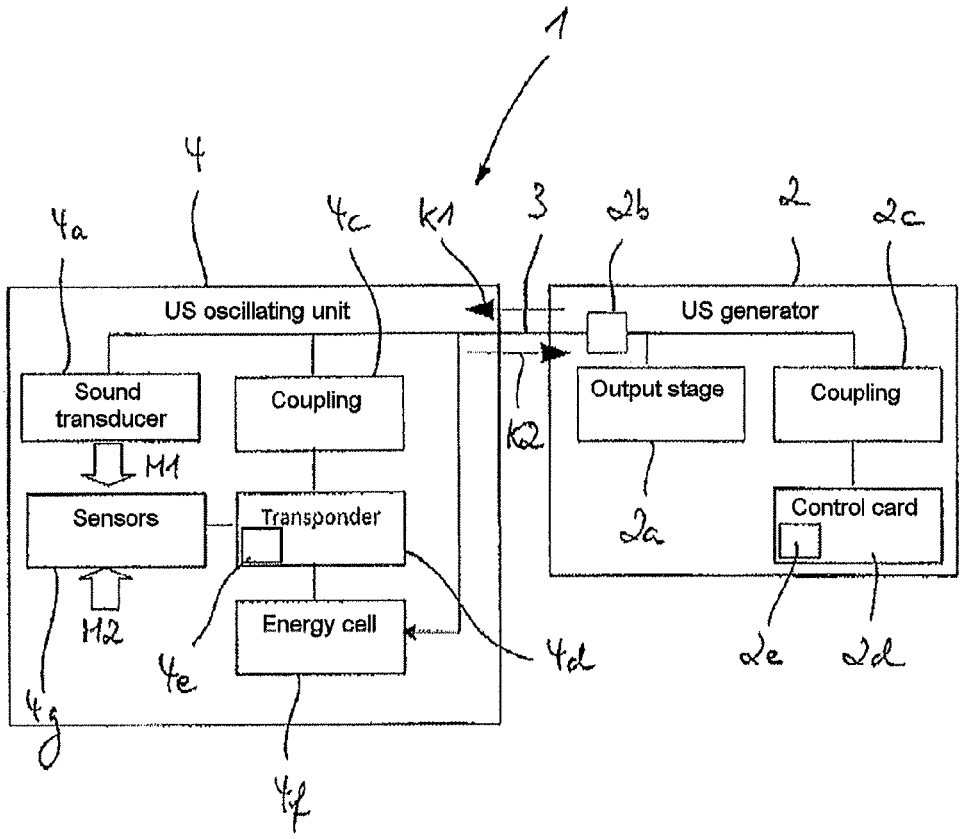
FIG. 3 schematically shows yet another configuration of an ultrasonic appliance according to the invention having a communication device according to the invention for carrying out the method according to the invention.

FIG. 3 uses a block diagram to schematically show yet another configuration of the ultrasonic appliance 1, in which case again only the special features in comparison with FIG. 1 and FIG. 2 are discussed in more detail.

The ultrasonic appliance 1 according to FIG. 3 corresponds substantially to the configuration in FIG. 2. In this case too, the transponder 4*d* is an active transponder which is supplied with electrical energy via an energy cell 4*f*.

Deviating from the illustration in FIG. 2, the ultrasonic appliance 1 according to FIG. 3 contains, on the side of the ultrasonic oscillating unit 4, a number of sensors which are collectively denoted using the reference symbol 4*g*. These sensors 4*g* may be, in particular, temperature or moisture sensors without the invention being restricted to such sensor types. For further details, reference is made to the introductory part of the description. As illustrated in FIG. 3 using the arrows M1, M2, the sensors 4*g* record physical measured values which are connected to the ultrasonic oscillating unit 4. By way of example, the arrow M1 symbolizes monitoring of the temperature of the sound transducer 4*a*, while reference symbol M2 symbolizes a measurement of the moisture in the interior of the ultrasonic oscillating unit 4, for example if the ultrasonic oscillating unit is immersed in a liquid cleaning medium. The measured values or measurement data recorded by the sensors 4*g* are delivered to the transponder 4*d* which, depending on its own data-processing capabilities, preprocesses said values or data or communicates them directly to the ultrasonic generator 2 via the HF supply line 3. In this manner, dynamically determined property data relating to the ultrasonic oscillating unit can also be used to control the operation of the ultrasonic appliance 1. The actual control is again preferably carried out by the ultrasonic generator 2 or its control card 2*d*, which has already been discussed further above.

Figure 4:
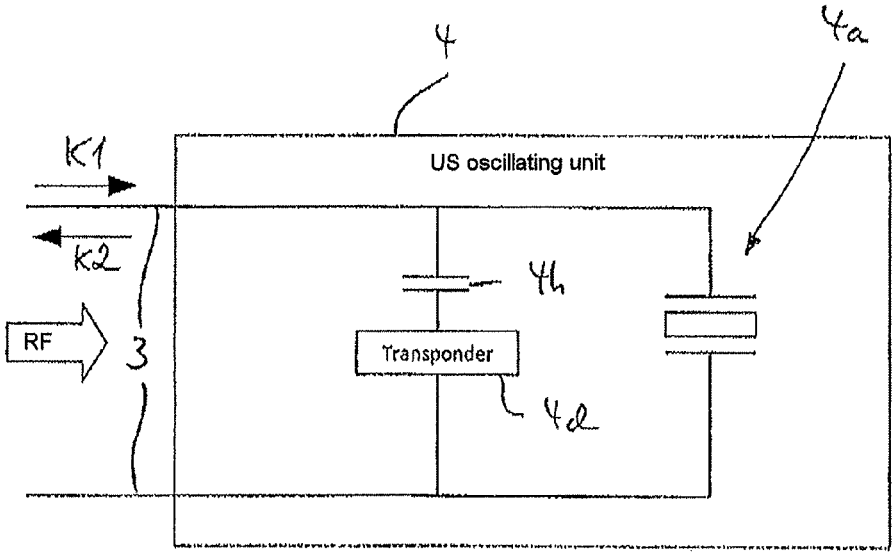
FIG. 4 schematically shows coupling of a transponder in/to the ultrasonic oscillating unit.

FIG. 4 uses a block diagram to schematically show the capacitive coupling of the transponder 4*d* in the ultrasonic oscillating unit 4 to the HF supply line 3 which is illustrated as a forward and return line in FIG. 4 and the subsequent figures. The block arrow HF symbolizes the HF supply for the ultrasonic oscillating unit 4. The ultrasonic generator is not illustrated in FIG. 4 and the subsequent figures. Otherwise, the same reference symbols in all figures correspond to identical or identically acting elements.

As can be explicitly gathered from FIG. 4, a capacitor 4*h* which ensures that the transponder 4*d* is capacitively coupled is connected between the HF supply line 3 coming from the ultrasonic generator and the transponder 4*d*. The electrical properties of the capacitor 4*d* and of the ultrasonic transducer 4*a* illustrated in the form of an equivalent circuit diagram are selected in such a manner that the actual HF excitation signal acts substantially only on the ultrasonic transducer 4*a*, while the communication signal (reference symbol K1), which is preferably in the form of higher-frequency modulation based on the HF supply signal, acts substantially only on the transponder 4*d* via the coupling using the capacitor 4*h* which acts as the coupling element 4*c* according to FIGS. 1 to 3.

Figure 5:
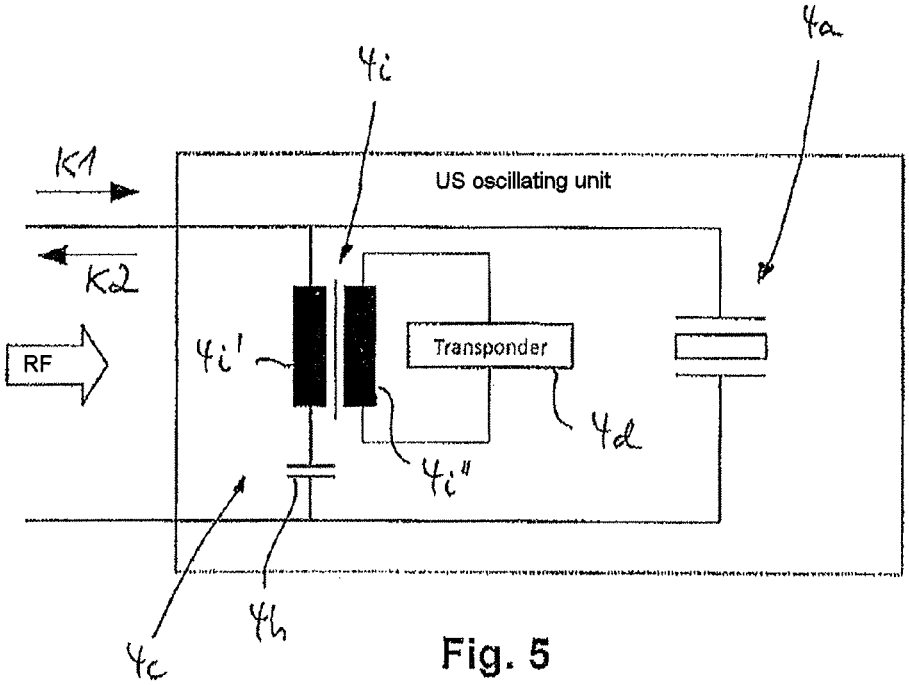
FIG. 5 schematically shows coupling of a transponder to a transformer inside the ultrasonic oscillating unit.

FIG. 5 shows an alternative configuration of the coupling of the transponder 4*d* in the ultrasonic oscillating unit 4. According to FIG. 5, the coupling is carried out capacitively and inductively using a capacitor 4*h* and a transformer 4*i*, the transformer 4*i* having a primary-side inductance 4*i*' and a secondary-side inductance 4*i*". The transponder 4*d* is connected to the secondary-side inductance 4*i*", as illustrated in FIG. 5. According to FIG. 5, the capacitor 4*h* and the transformer 4*i* act as the coupling element 4*c* (cf. FIGS. 1 to 3).

Figure 6:
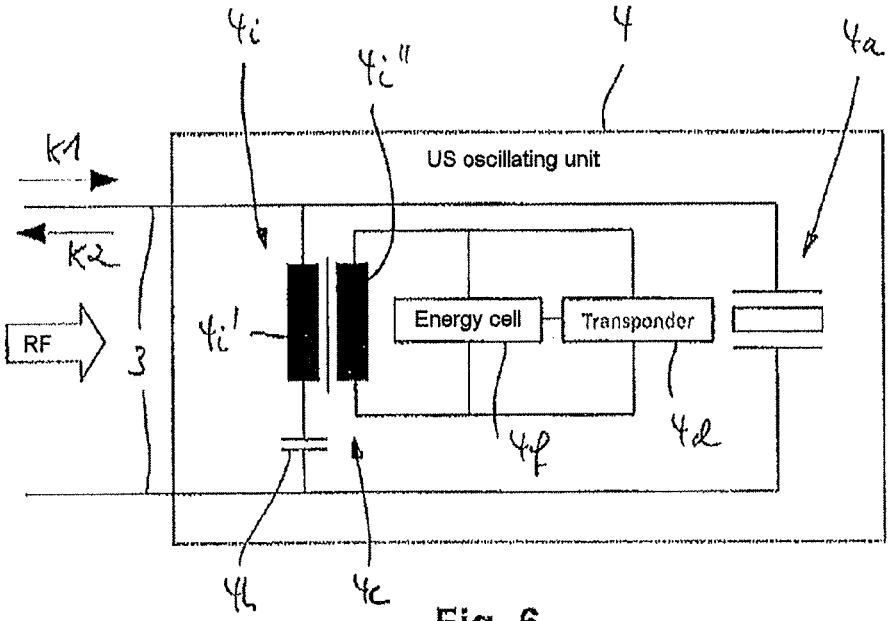
FIG. 6 schematically shows the coupling of a transponder in/to the ultrasonic oscillating unit having a transformer and an energy cell.

FIG. 6 uses a block diagram to schematically show the extension of the configuration according to FIG. 5 with an energy cell 4*f* for supplying the (active) transponder 4*d*. The energy cell 4*f* is connected in parallel with the transponder 4*d* on the secondary side of the transformer 4*i* and has an electrical operative connection to the transponder in order to supply the transponder 4*d* with electrical energy. The operative connection of the transponder 4*d* to the coupling element 4*c* (capacitor 4*h* and transformer 4*i*) is therefore used exclusively for communication purposes.

According to FIGS. 5 to 8, the electrical properties of the coupling element 4*c*, that is to say of the capacitor 4*h* and of the transformer 4*i*, are selected in such a manner that the actual HF excitation signal is "seen" substantially only by the ultrasonic transducer 4*a*, while the transponder 4*d* "sees" substantially only a communication part (high-frequency modulation) of the HF excitation signal.

Figure 7:
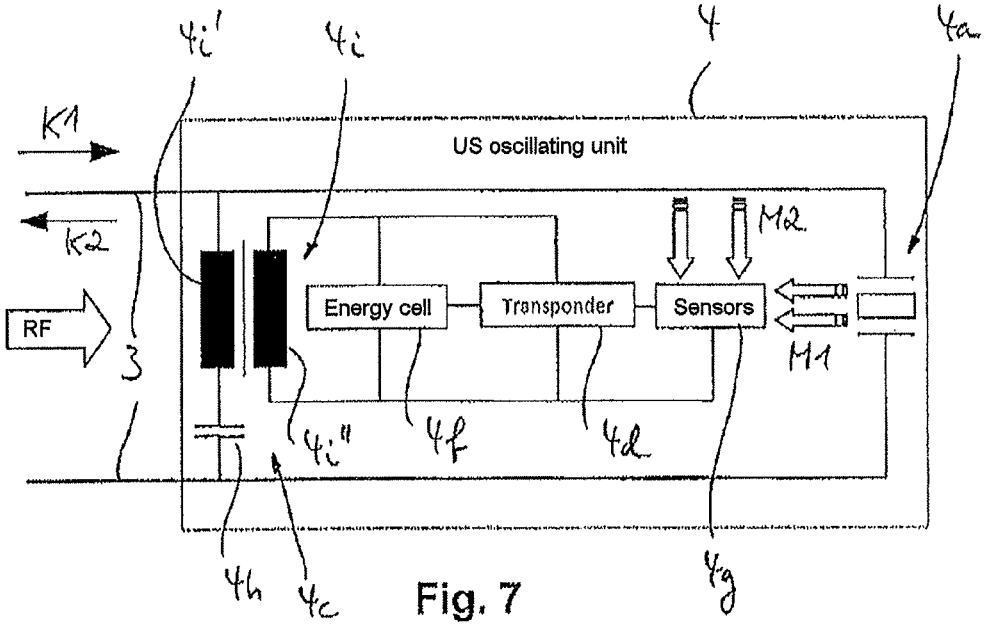
FIG. 7 schematically shows the coupling of a transponder in/to the ultrasonic oscillating unit having a transformer, an energy cell and sensors.

FIG. 7 is a development of the configuration shown in FIG. 6 in which the sensors 4*g* already mentioned are additionally used. The sensors 4*g* have an operative connection to the energy cell 4*f*, on the one hand, and to the transponder 4*d*, on the other hand. For further details, reference is made to the illustration in FIG. 7 and to the above description of FIG. 3.

Figure 8:
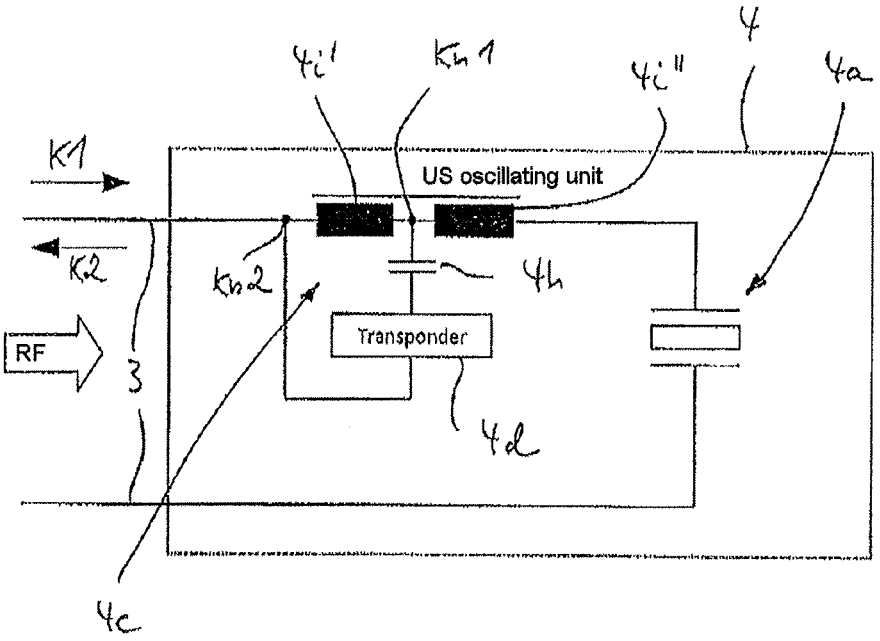
FIG. 8 schematically shows the coupling of a transponder in/to the ultrasonic oscillating unit as an alternative to the illustration in FIG. 5.

Finally, FIG. 8 shows coupling of the transponder 4*d* as an alternative to FIG. 5. The important difference between the configurations according to FIG. 5 and FIG. 8 lies in the configuration and connection of the transformer 4*i* which can also be referred to as an "autotransformer" in the configuration according to FIG. 8. The capacitance 4*h* used to capacitively couple the transponder 4*d* is connected between the transponder 4*d* and a node Kn1, which node Kn1 is arranged between the two windings 4*i*', 4*i*" of the transformer 4*i*. Further connection of the transformer 4*d* to the HF supply line 3 is carried out upstream of the transformer 4*i* in a node Kn2. In the case of FIG. 8 as well, the transponder 4*d*, like in FIG. 4 and FIG. 5 as well, is in the form of a passive transponder which is supplied with electrical energy in a "parasitic" manner via the HF supply line 3.

Figure 9:
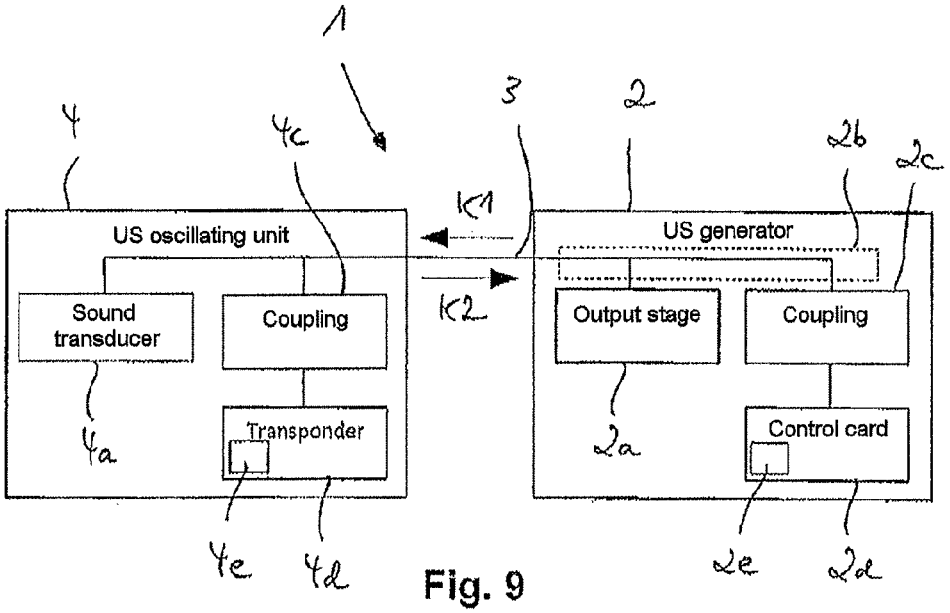
FIG. 9 schematically shows a modification of the configuration according to FIG. 1.

FIG. 9 schematically shows a modification of the first configuration according to FIG. 1. As can be gathered from the illustration in FIG. 9, the communication signal is coupled here in or to the matching network which is symbolized using a dashed rectangle 2*b* in FIG. 9. As discerned by a person skilled in the art, this type of coupling can also be readily applied to the subject matter of FIG. 2 and to the subject matter according to FIG. 3.

Figure 10:
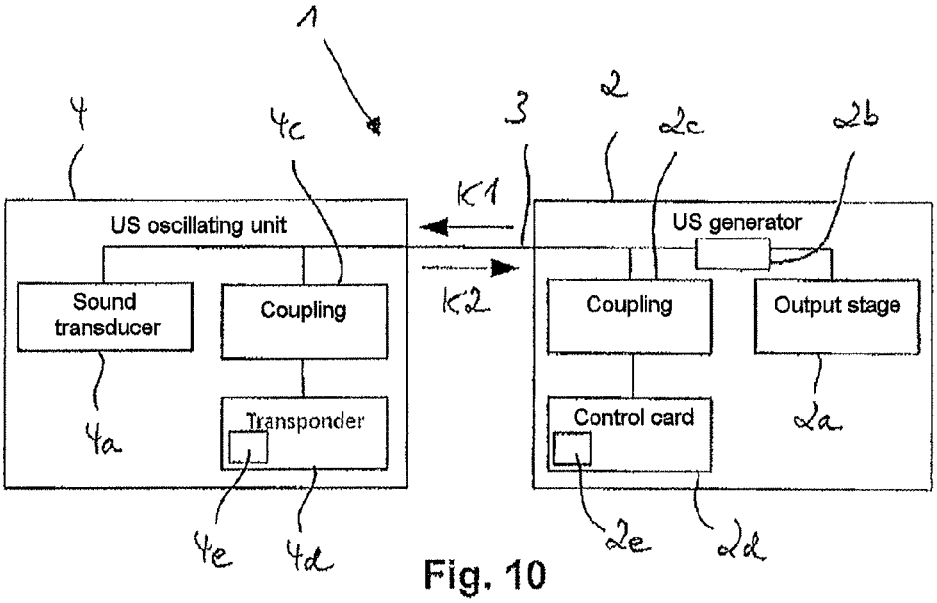
FIG. 10 schematically shows another modification of the configuration according to FIG. 1.

According to the configuration in FIG. 10, the coupling is carried out using the coupling element 2*c* downstream of the matching network 2*b*, whereas it was carried out upstream of the matching network 2*b* according to FIGS. 1 to 3. In this respect too, the coupling according to FIG. 10 can also be readily applied to the subject matters of FIGS. 2 and 3. The invention is therefore in no way restricted to particular localization of the coupling in the ultrasonic generator 2.

The invention claimed is:

1. A method for operating an ultrasonic appliance (1), comprising providing the ultrasonic appliance having an ultrasonic generator (2) and an ultrasonic oscillating unit (4) which has an electrical operative connection to the ultrasonic generator, the ultrasonic generator supplying an ultrasonic transducer (4*a*) contained in the ultrasonic oscillating unit with electrical energy and exciting said ultrasonic oscillating unit to generate ultrasound, the ultrasonic oscillating unit (4) and the ultrasonic generator (2) communicating (K1, K2) with one another via at least one of an operative data or signal connection, and the ultrasonic oscillating unit transmitting identification data to the ultrasonic generator, with said identification data allowing the ultrasonic generator to recognize the ultrasonic oscillating unit, with the communication being carried out via a high-frequency supply line (3) that transmits the electrical energy in the form of a high-frequency excitation signal between the ultrasonic generator (2) and the ultrasonic oscillating unit (4) that is used by the ultrasonic oscillating unit to generate ultrasound.

2. The method as claimed in claim 1, further comprising the ultrasonic oscillating unit (4) also transmitting particular pre-stored or dynamically determined property data relating to the ultrasonic oscillating unit to the ultrasonic generator (2).

3. The method as claimed in claim 2, wherein an operating state of at least one of the ultrasonic appliance (1) or of the ultrasonic generator (2) is automatically selected on the basis of a result of at least one of the recognition or the property data.

4. The method as claimed in claim 1, wherein the communication (K1, K2) is carried out in a bidirectional manner, the ultrasonic generator (2) transmitting data to the ultrasonic oscillating unit (4), and said data being stored in the ultrasonic oscillating unit.

5. The method as claimed in claim 1, wherein elements (2*d*, 2*e*; 4*d*, 4*e*) of at least one of the ultrasonic generator (2) or of the ultrasonic oscillating unit (4) which are involved in communication are coupled to the radio-frequency supply line (3) or to a separate, wireless or wired communication connection between the ultrasonic generator (2) and the ultrasonic oscillating unit (4) in a contactless manner.

6. The method as claimed in claim 1, wherein a signal is used for communication (K1, K2), said signal is modulated at a modulation frequency which is different from an excitation frequency for the ultrasonic oscillating unit (4).

7. The method as claimed in claim 1, wherein elements (4*d*, 4*e*) of the ultrasonic oscillating unit (4) which are involved in communication are supplied with electrical energy by a separate energy supply (4*f*) for the ultrasonic oscillating unit (4), or elements (4*d*, 4*e*) of the ultrasonic oscillating unit (4) which are involved in communication are supplied with electrical energy passively without a separate energy supply for the ultrasonic oscillating unit.

8. An ultrasonic appliance (1), comprising an ultrasonic generator (2) and an ultrasonic oscillating unit (4) which has an electrical operative connection to the ultrasonic generator, the ultrasonic generator (2) being designed to supply an ultrasonic transducer (4*a*) contained in the ultrasonic oscillating unit (4) with electrical energy in the form of a high-frequency excitation signal that is used to excite the ultrasonic oscillating unit to generate ultrasound, a communication device that forms at least one of an operative data or signal communication connection between the ultrasonic oscillating unit (4) and the ultrasonic generator (2), the ultrasonic oscillating unit (4) being designed to transmit data in the form of at least one of identification data or property data to the ultrasonic generator (2) via the operative communication connection, and the ultrasonic generator being designed to recognize the ultrasonic oscillating unit (4) using the data, and a high-frequency supply line (3) that transmits the electrical energy between the ultrasonic generator (2) and the ultrasonic oscillating unit (4) acts as the operative communication connection.

9. The communication device as claimed in claim 8, further comprising an active or passive transponder (4*d*) that has an operative connection to the ultrasonic oscillating unit (4), said transponder (4*d*) has at least one of the identification data or the property data or has access to at least one of the identification data or property data for the purpose of transmission to the ultrasonic generator, at least one sensor (4*g*) has an operative connection to the ultrasonic oscillating unit (4), the sensor data (M1, M2) from said sensor is part of or forms the basis of at least the property data.

10. The communication device as claimed in claim 8, wherein the ultrasonic generator (2) has a control unit (2*e*) which is designed to communicate with the ultrasonic oscillating unit (4) and to evaluate the data received from the ultrasonic oscillating unit (4) in order to automatically select an operating state of the ultrasonic generator (2).

11. The communication device as claimed in claim 8, wherein the operative communication connection is in the form of a separate wireless or wired communication connection between the ultrasonic generator (2) and the ultrasonic oscillating unit (4).

12. The communication device as claimed in claim 8, wherein the operative communication connection is designed for bidirectional communication (K1, K2) between the ultrasonic generator (2) and the ultrasonic oscillating unit (4), the ultrasonic generator is designed to transmit data to the ultrasonic oscillating unit (4), and said data is stored in a storage element (4*e*) which has an operative connection to the ultrasonic oscillating unit (4).

13. The method of claim 2, wherein the properties include at least one of nominal power, power loss, resonant frequencies, serial number, production date, sound emission time, impedance profile, starting or stopping frequencies for determining at least one of an operating range, temperature, or moisture.

* * * * *